US011286668B1

(12) United States Patent
Cramer

(10) Patent No.: US 11,286,668 B1
(45) Date of Patent: Mar. 29, 2022

(54) INTERCONNECTING SLAB BOLSTER UPPERS

(71) Applicant: OCM, INC., Grayslake, IL (US)

(72) Inventor: Andy Cramer, Johnsburg, IL (US)

(73) Assignee: OCM , Inc., Grayslake, IL (US)

( * ) Notice: Subject to any disclaimer, the term of this patent is extended or adjusted under 35 U.S.C. 154(b) by 0 days.

(21) Appl. No.: 17/090,147

(22) Filed: Nov. 5, 2020

(51) Int. Cl.

| | |
|---|---|
| ***E04C 5/20*** | (2006.01) |
| ***E04C 5/16*** | (2006.01) |
| *E01D 101/26* | (2006.01) |
| *E01C 11/18* | (2006.01) |

(52) U.S. Cl.
CPC ..... *E04C 5/20* (2013.01); *E04C 5/168* (2013.01); *E01C 11/18* (2013.01); *E01D 2101/26* (2013.01)

(58) Field of Classification Search
CPC . E04C 5/20; E04C 5/168; E04C 5/165; E01C 11/18; Y10T 403/553; Y10T 403/61
See application file for complete search history.

(56) References Cited

U.S. PATENT DOCUMENTS

| | | | | |
|---|---|---|---|---|
| 4,019,298 | A * | 4/1977 | Johnson, IV | E04B 1/185 52/590.1 |
| 4,942,714 | A * | 7/1990 | Langley, Jr | E01C 11/18 52/687 |
| 5,664,390 | A * | 9/1997 | Sorkin | E04C 5/20 52/677 |
| 6,735,918 | B2 | 5/2004 | Haslem et al. | |
| 6,775,954 | B1 | 8/2004 | Sorkin | |
| D621,239 | S * | 8/2010 | Sorkin | D8/354 |
| 10,106,985 | B1 | 10/2018 | Waldner et al. | |
| 10,329,768 | B2 * | 6/2019 | Verelli | E04C 5/168 |
| 2006/0096197 | A1 * | 5/2006 | Tollefson | E04C 5/10 52/223.13 |
| 2008/0060294 | A1 | 3/2008 | Cox et al. | |
| 2008/0184656 | A1 | 8/2008 | Lee et al. | |
| 2017/0260770 | A1 * | 9/2017 | Xu | E04H 15/44 |
| 2021/0108414 | A1 * | 4/2021 | Cross | E04C 5/20 |

FOREIGN PATENT DOCUMENTS

| | | | | |
|---|---|---|---|---|
| EP | 2975189 | A1 * | 1/2016 | E04C 5/20 |

* cited by examiner

*Primary Examiner* — Christine T Cajilig
(74) *Attorney, Agent, or Firm* — Liell & McNeil

(57) ABSTRACT

A plurality of identical slab bolster uppers each include a body with a rebar contact surface separated a height distance from a ground contact surface along a vertical axis. The rebar contact surface extends from a first end to a second end along a horizontal axis. The first end terminates in a planar abutment surface that is one side of a thickness profile, and the second end has a different shape that includes a planar abutment surface, and a snap-fit connector shaped to receive the thickness profile of the first end. Two slab bolster uppers may be moved from a disconnected configuration to a connected configuration exclusively responsive to sliding the planar surfaces along one another while in contact along a vertical axis until the thickness profile of the one slab bolster upper is received in the snap-fit connector on the other slab bolster upper.

20 Claims, 5 Drawing Sheets

INTERCONNECTING SLAB BOLSTER UPPERS

TECHNICAL FIELD

The present disclosure relates generally to slab bolster uppers that support rebar enforcements in a concrete form, and more particularly to interconnecting slab bolster uppers that utilize a snap-fit connection.

BACKGROUND

Reinforced concrete typically includes steel rebar reinforcement that is held within the concrete mold by supports commonly known as slab bolster uppers. Slab bolster uppers, which may be plastic or metallic, come in a variety of heights so that the user can position the rebar at a selected location within the mold before the concrete is poured. In addition to a variety of heights, slab bolster uppers may be provided in fixed lengths, and placed end to end at the concrete forming site when the dimensions of a given concrete mold are greater than the length of one slab bolster upper. The industry has seen fit to provide strategies for joining slab bolster uppers end to end to provide a continuous rebar support surface across a complete dimensional span of the concrete mold. Unfortunately, many of these end to end joining strategies suffer from a variety of drawbacks, including but not limited to introducing a weak spot where the slab bolster uppers are joined that can be easily broken. In addition, many connection strategies permit some swiveling about the connection location that can undermine the ability to lay out the precise grid of rebar supports in a given concrete mold. Other strategies inhibit the ability of joined slab bolster uppers to be easily moved and relocated in a mold area prior to the concrete being poured.

The present disclosure is directed toward one or more of the problems set forth above.

SUMMARY

In one aspect, a plurality of slab bolster uppers include a first slab bolster upper that is identical to a second slab bolster upper. Each includes a body having a rebar contact surface separated a height distance from a ground contact surface along a vertical axis. The rebar contact surface extends from a first end to a second end of the body along a horizontal axis. The first end terminates at a first vertical planar abutment surface that is one side of a thickness profile. The second end has a different shape than the first end, and includes a second vertical planar contact abutment surface, and includes a snap-fit connector shaped to receive the thickness profile of the first end. The first and second slab bolster uppers are movable from a disconnected configuration to a connected configuration exclusively responsive to sliding the second end of one of the bolsters relative to the first end of the other slab bolster upper along the vertical axis while the respective second vertical planar abutment surface is in contact with the respective first vertical planar abutment surface.

In another aspect, a method of joining a first slab bolster upper to a second slab bolster upper includes positioning the first slab bolster upper and the second slab bolster upper in a disconnected configuration. The second slab bolster upper is moved relative to the first slab bolster upper from the disconnected configuration to a connected configuration that is characterized by respective horizontal axes of the first and second bolster uppers being coincident. The moving step includes sliding a second vertical planar abutment surface of the second slab bolster upper along a vertical axis relative to, and in contact with, a first vertical planar abutment surface of the first slab bolster upper. During this process, a thickness profile of one end of the first slab bolster upper is received into a snap-fit connector of the second slab bolster upper. The first vertical planar abutment surface is a terminal end of the first slab bolster upper.

DETAILED DESCRIPTION

Figure 1:
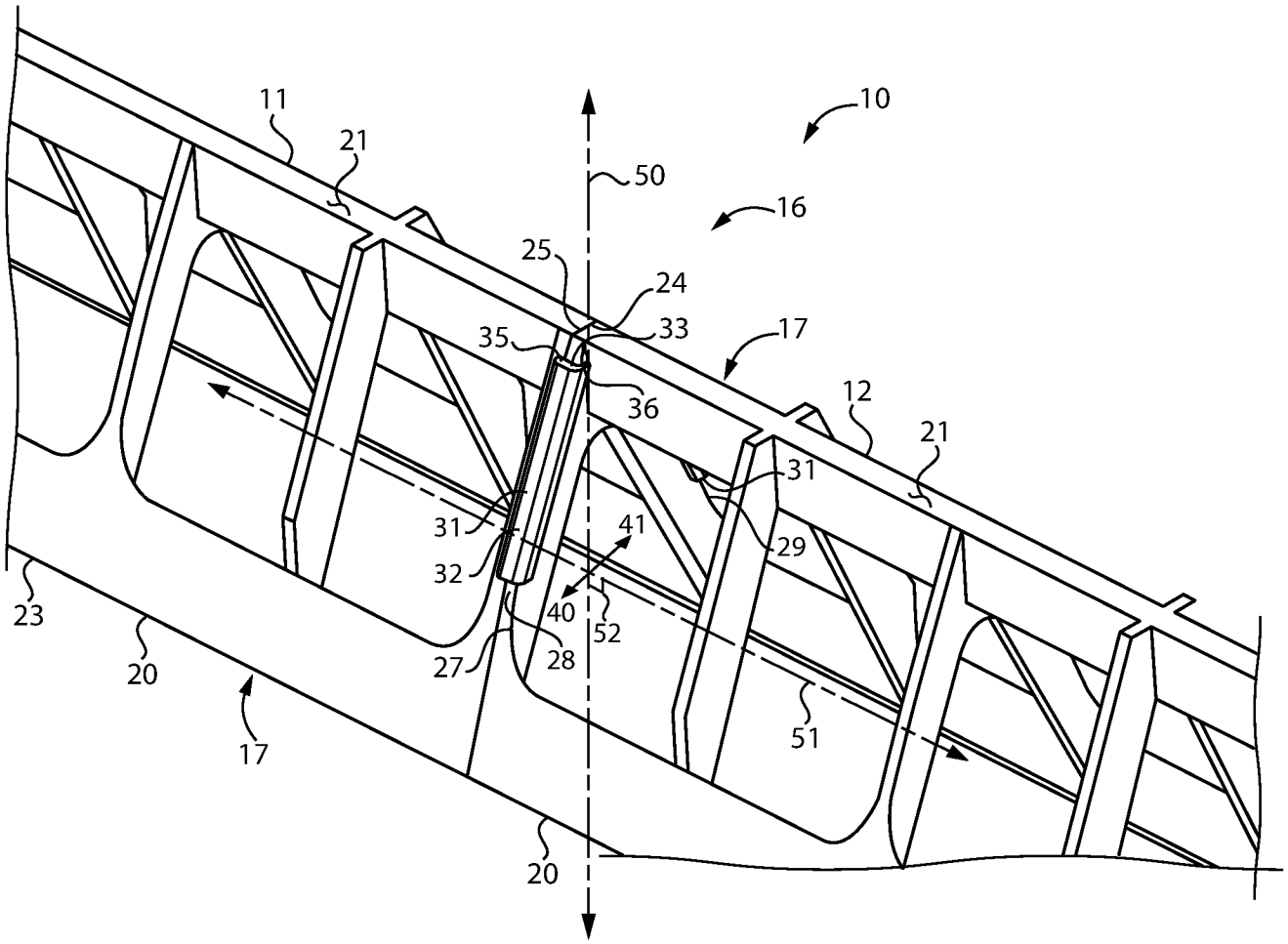
FIG. 1 is a partial perspective view of a pair of slab bolster uppers joined according to the present disclosure.
Figure 2:
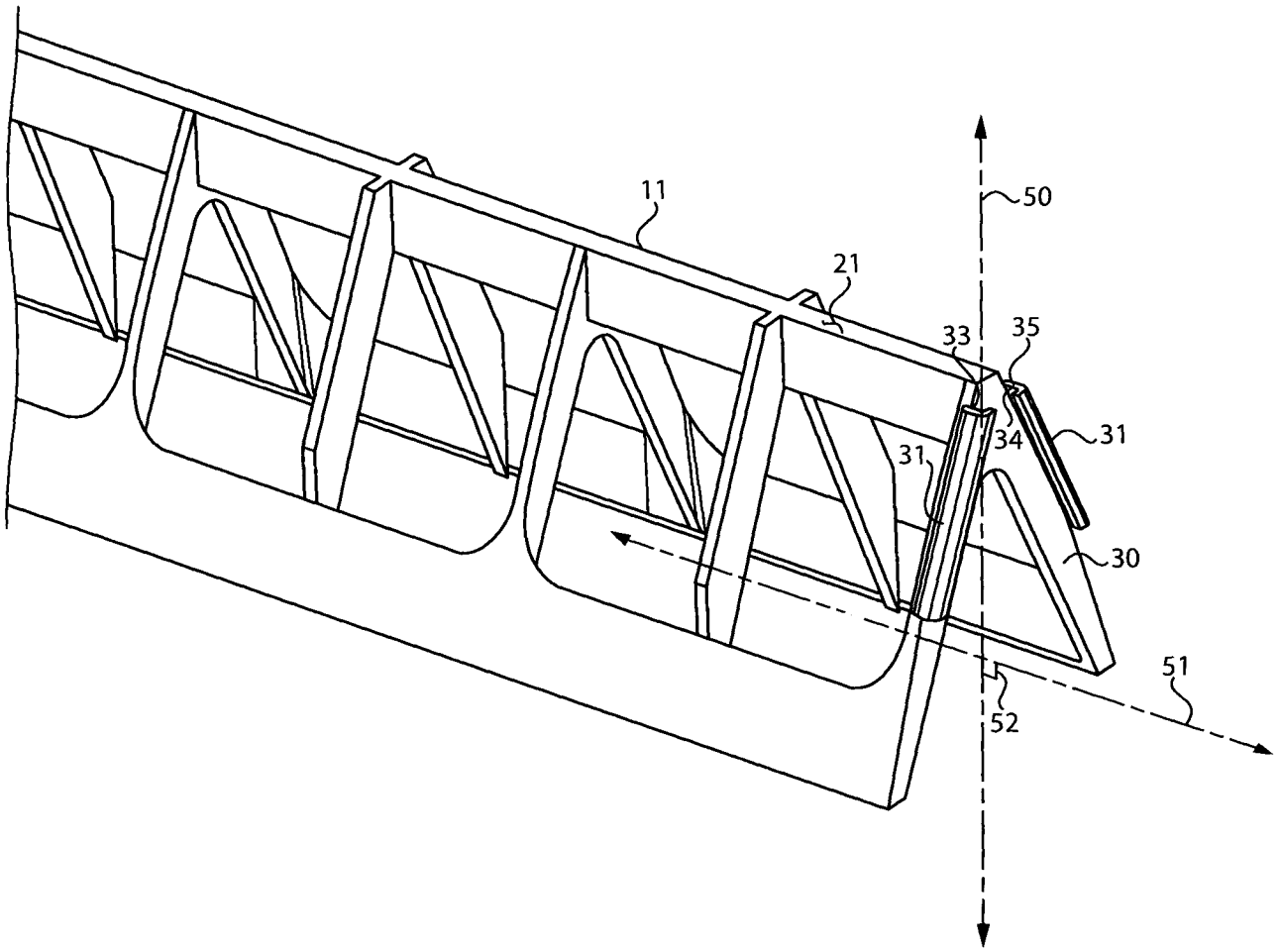
FIG. 2 is a perspective view of one of the slab bolster uppers showing the snap-fit connector located at one end.
Figure 3:
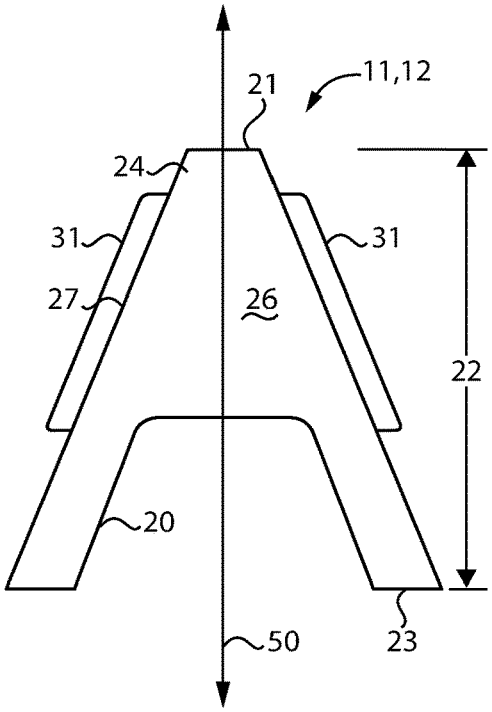
FIG. 3 is an end view of a slab bolster upper.
Figure 4:
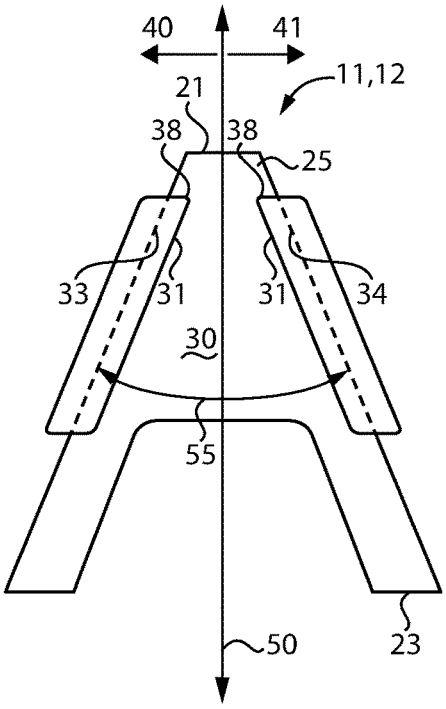
FIG. 4 is an opposite end view of the slab bolster upper of FIG. 3, showing the end that includes the snap-fit connector.
Figure 5:
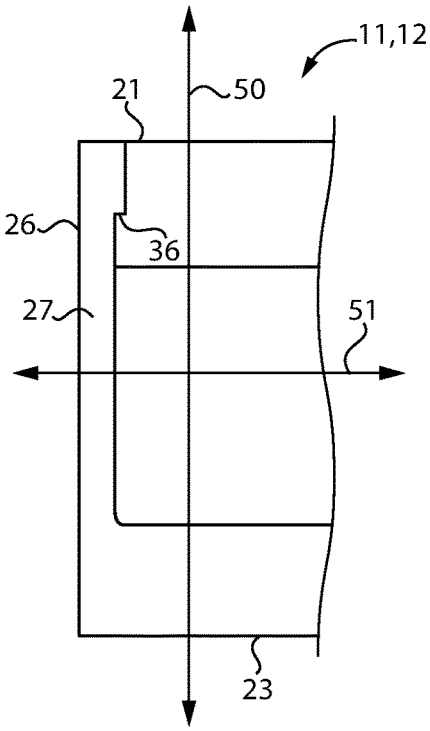
FIG. 5 is a partial front view of the end of the slab bolster upper shown in FIG. 3.
Figure 6:
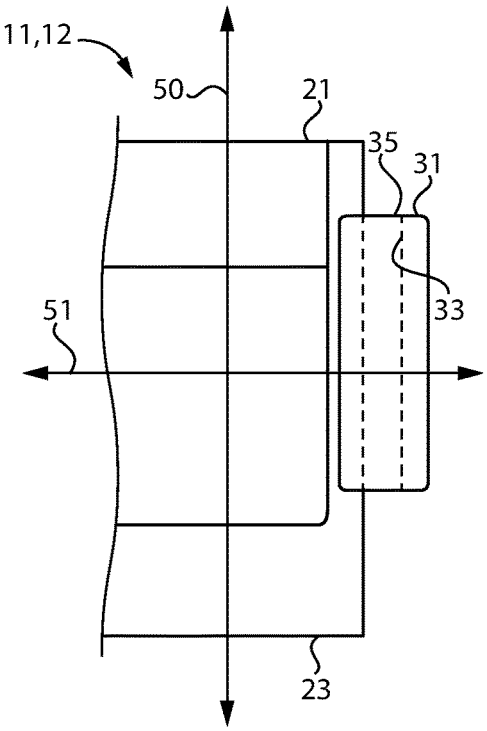
FIG. 6 is a front side view of the opposite end of the slab bolster upper associated with the end shown in FIG. 5.

Referring now initially to FIG. 1, a pair of identical slab bolster uppers 10 are shown in a connected configuration 16. In particular, a first slab bolster upper 11 is connected end-to-end with an identical second slab bolster upper 12. Each of the slab bolster uppers 10, 12 includes a body 20 that has a rebar contact surface 21 that is located opposite to a ground contact surface 23 along a vertical axis 50. The rebar contact surface 21 extends from a first end 24 to a second end 25 of the body 20 along the horizontal axis 51. The first end 24 terminates at a first vertical planar abutment surface 26 that is one side of a thickness profile 27.

Referring now in addition to FIGS. 2-6, the rebar contact surface 21 is separated a height distance 22 from the ground contact surface 23 along the vertical axis 50. The second end 25 of each of the slab bolster uppers 11, 12 has a different shape than the first end 24, and includes a second vertical planar abutment surface 30 and a snap-fit connector 31 shaped to receive a thickness profile 27 of the first end 24. As used in the present disclosure, a "snap-fit connector" means interlocking component parts that may be pushed together and become attached without separate fasteners, adhesives or the like. At least one of the parts undergoes an elastic deformation when moving between a disconnected configuration and a connected configuration. A snap-fit connection is a mechanical joint system where part-to-part attachment is accomplished with locating and locking features (constraint features) that are homogenous with one or the other of the components being joined. Joining requires flexible locking features to briefly undergo elastic deformation for engagement with the mating part, followed by a return of the locking feature toward its original position to accomplish the interference required to latch the components together. In general, locater features, the second type of constraint feature, are inflexible, providing strength and stability in the attachment. A permanent snap-fit connection includes engagement surfaces that prevent the reverse movement of parts from a connected configuration to a disconnected configuration.

In the illustrated embodiment, the snap-fit connector 31 includes the body 20 defining a pair of grooves 33, 34 that receive respective portions 28, 29 of the thickness profile 27. The pair of grooves 33, 34 and the respective portions 28, 29 of the thickness profile 27 are located on opposite sides 40, 41 of a plane 52 that is defined by the vertical axis 50 and the horizontal axis 51. The grooves 33 and 34 have a width that matches, and is sized to receive, the thickness of thickness profile 27. The bottom surfaces of grooves 33 and 34 are at an angle 55 with respect to one another that is bisected by the vertical axis 50. This angle 55 matches the angle defined by the outer edges of the thickness profile 27. In this way, when the thickness profile 27 is received into grooves 33 and 34, the two slab bolster uppers 11 and 12 are held snuggly together with first vertical planar abutment surface 26 at end 24 held abutting second vertical planar abutment surface 30 of the second end 25. By holding the two planar abutment surfaces 26 and 30 in contact, swiveling of one slab bolster upper 11 relative to the other slab bolster upper 12 about any axis perpendicular to horizontal axis 51 is prevented. In addition to the planar abutment surfaces 26 and 30 being abutting each other, the outer edges of thickness profile 27 abut the counterpart bottom surfaces defined by grooves 33 and 34. In this way, the two parts, when in a connected configuration 16, have contact with one another in at least three distinctive and non-contiguous planes.

Although not necessary, the snap-fit connector 31 of the present disclosure is preferably a permanent snap-fit connector 32. A permanent snap-fit connector according to the present disclosure means that surfaces on each of the components arrive in a position opposite each other that blocks the snap-fit connector from being moved from a connected configuration 16 to a disconnected configuration along a same pathway to which the component parts moved in order to arrive at the connected configuration. In this case, the permanent snap-fit connector 32 is made permanent due to the inclusion of a pair of catch surfaces 36 that are oriented perpendicular to the vertical axis 50 and located on the opposite sides 40 and 41 of a plane defined by the vertical axis 50 and the horizontal axis 51. The pair of catch surfaces 36 block the snap-fit connector 31 from moving from the connected configuration 16 toward a disconnected configuration. In particular, the top surface 35 of the grooves 33 and 34 snaps into a position abutting catch surfaces 36 at the connected configuration 16.

Although the slab bolster uppers 11, 12 of the present disclosure could be manufactured from metal, each of the identical slab bolster uppers 11, 12 preferably consists solely of a single integral piece of molded plastic 17 that includes all the features previously described including, but not limited to the rebar contact surface 21, the ground contact surface 23, the intermediate scaffolding, along with the snap-fit connector 31 and its counterpart thickness profile 27 at opposite ends.

Figure 7:
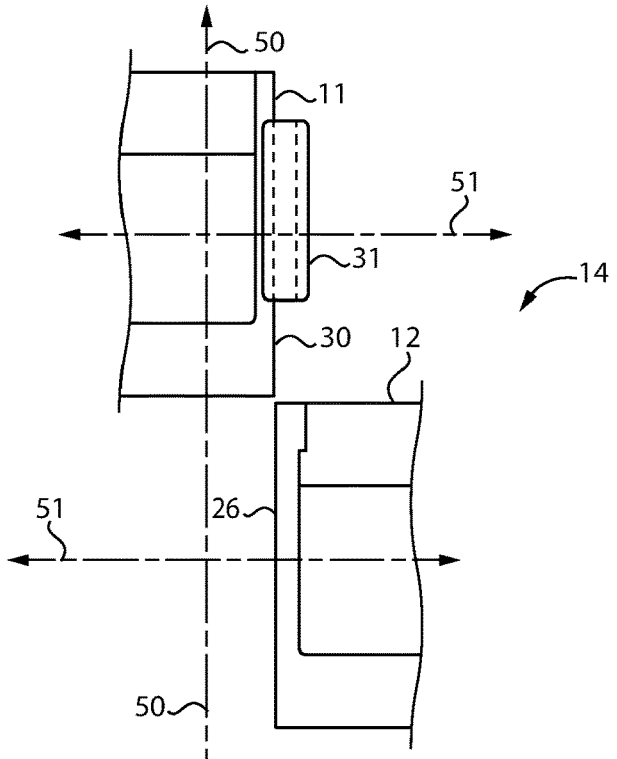
FIG. 7 is a partial front view of a pair of slab bolster uppers in a disconnected configuration.
Figure 8:
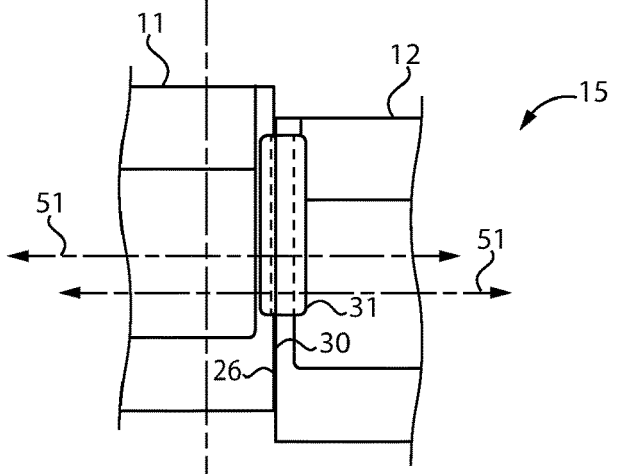
FIG. 8 is a front side view showing the slab bolster uppers of FIG. 7 in a pre-connected configuration.
Figure 9:
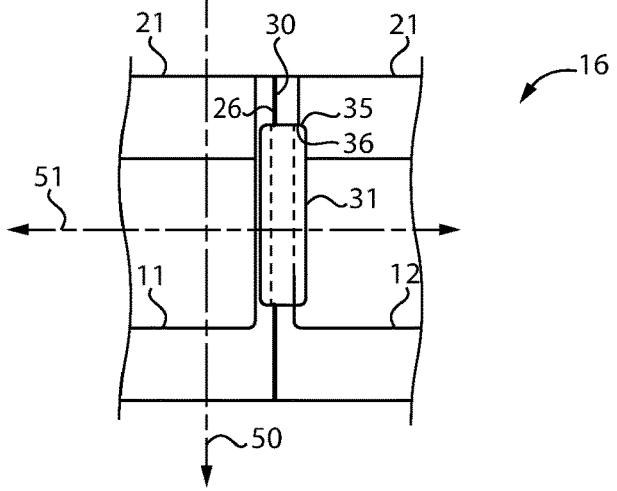
FIG. 9 shows the slab bolster uppers of FIGS. 7 and 8 in a connected configuration.
Figure 12:
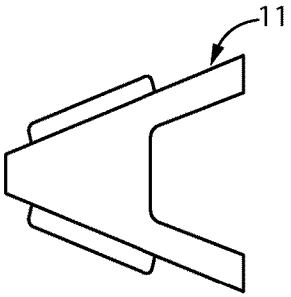
FIG. 12 is a right side view of the slab bolster upper.
Figure 11:
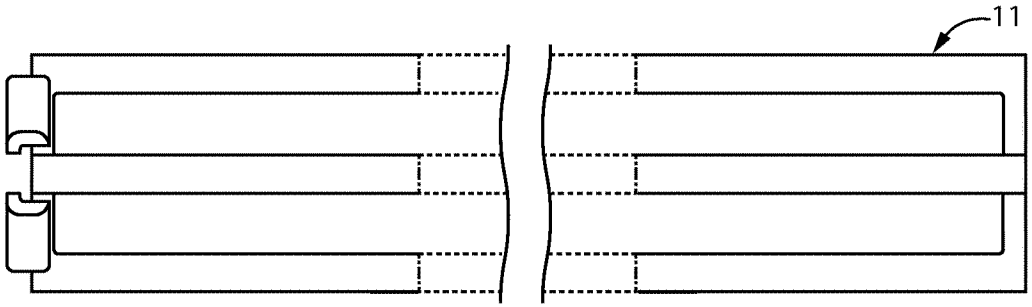
FIG. 11 is a partial top view of the slab bolster upper in FIG. 10.
Figure 13:
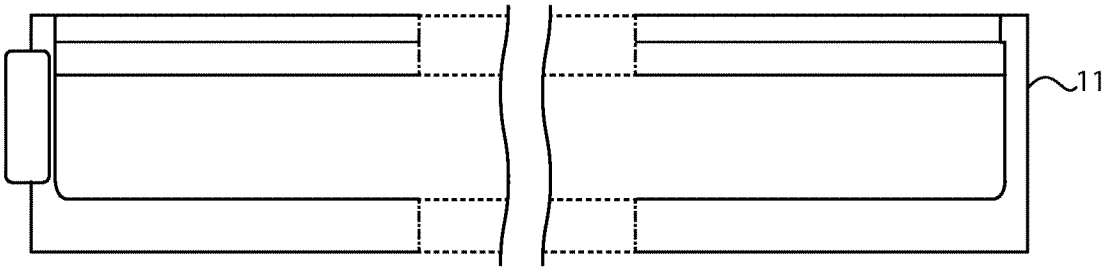
FIG. 13 is a partial front view of the slab bolster upper of FIGS. 10-12.
Figure 10:
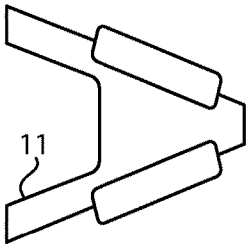
FIG. 10 is a left side view of a slab bolster upper.
Figure 14:
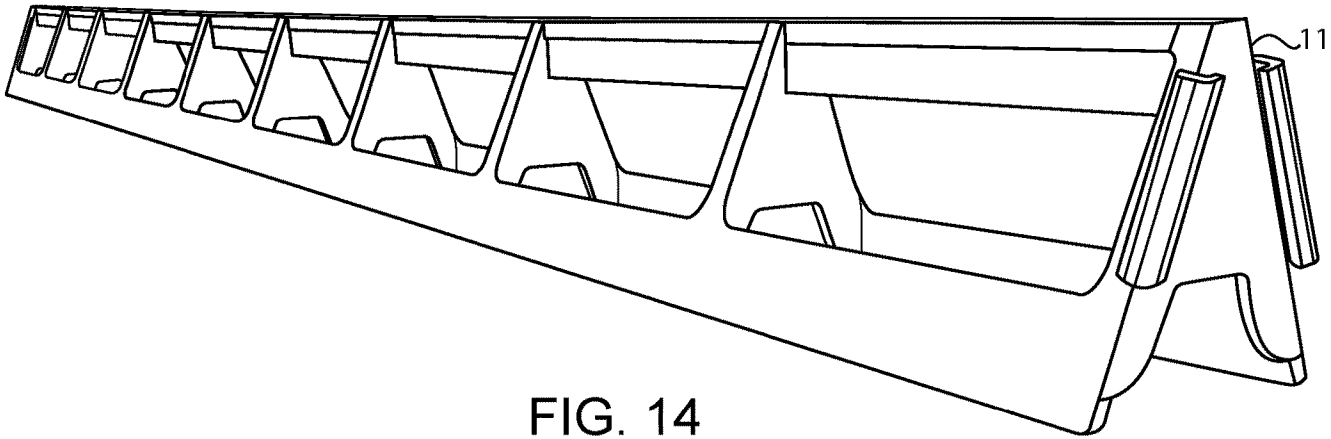
FIG. 14 is a perspective view of the slab bolster upper of FIGS. 10-13.

As best shown in FIGS. 7, 8 and 9, the first and second slab bolster uppers 11, 12 are movable from a disconnected configuration 14 as shown in FIG. 7 to a connected configuration 16 as shown in FIG. 9 exclusively responsive to sliding the second end 25 of one of the bolsters 12 relative to the first end 24 of the other bolster 11 along the vertical axis 50 while the respective second vertical planar abutment surface 30 is in contact with the respective first vertical planar abutment surface 26. Preferably, both of the slab bolster uppers 11 and 12, including the snap-fit connector 31, are un-deformed in both the disconnected configuration 14 and the connected configuration 15. The slab bolster uppers 11, 12 may move through a pre-connected configuration 15 that is between the disconnected configuration 14 and the connected configuration 16, as shown in FIG. 8, which is characterized by the snap-fit connector 31 being elastically deformed responsive to contact with the first end 24 of the other bolster 12. In particular, the thickness profile spread angle 55 may act as a wedge pushing the grooves of the snap connector 31 slightly apart during the last minority fraction of movement from the disconnected configuration 14 to the connected configuration 16. Prior to this wedging effect, portions of the thickness profile 27 may already be interacting with the grooves 33 and 34 to help guide the movement in the abutment plane where surfaces 26 and 30 contact. After moving through the pre-connected configuration 15, the grooved portions of the snap-fit connector 31 snap back toward their un-deformed configuration and are blocked from moving back toward a disconnected configuration due to the interaction of top surface 35 with catch surface 36. Preferably, the thickness profile 27 need not undergo any deformation when moving from the disconnected configuration 14 to the connected configuration 16.

Those skilled in the art will appreciate that the material out of which the slab bolster uppers 11 and 12 is made should be sufficiently strong to support the heavy load of multiple rebar reinforcements resting atop rebar contact surface 21, but sufficiently flexible to permit some de minimis deformation at snap-fit connector 31 without breaking. In one specific example, slab bolster uppers 11, 12 may be injection molded from ABS plastic material.

INDUSTRIAL APPLICABILITY

The present disclosure finds general applicability to support rebar in a reinforced concrete mold. In particular, the present disclosure permits multiple identical slab bolster uppers to be connected end-to-end to accommodate any sized concrete mold dimensions. Thus, the slab bolster uppers 11, 12 can be provided to a worksite in a box containing numerous identical slab bolster uppers. Furthermore, the snap-fit connector of the present disclosure is preferably sufficiently secure that a plurality of connected slab bolster uppers may be lifted, moved and otherwise relocated in a mold location without worry of pivoting and/or twisting between any two of the slab bolster uppers 11, 12.

Referring again to FIGS. 7-9, a method of joining a first slab bolster upper 11 to a second slab bolster upper 12 begins by positioning the first slab bolster upper 11 and the second slab bolster upper 12 in a disconnected configuration 14. For instance, one of the slab bolster uppers 12 may be positioned on the ground while the other slab bolster upper 11 is moved relative to the first slab bolster upper. In particular, the first slab bolster upper 11 may be moved relative to the second slab bolster upper 12 from the disconnected configuration 14 to the connected configuration 16 that is characterized by the respective horizontal axis 51 of the two slab bolster uppers 11 and 12 becoming coincident. This moving step is accomplished by sliding the second vertical planar abutment surface 30 of one of the slab bolster uppers 11 along the vertical axis 50 relative to, and in contact with, the first vertical planar contact surface 27 of the other slab bolster upper 12. This movement step is accompanied by receiving a thickness profile 27 of one end 24 of the slab bolster upper 12 into the snap-fit connector 31 of the other slab bolster upper 11. In the illustrated embodiment, the first vertical planar abutment surface 26 is the terminal end of the respective slab bolster upper 11 or 12. The slab bolster uppers move through a pre-connected configuration 15 when moving from the disconnected configuration 14 to the connected configuration 16. When this occurs, the snap-fit connector 31 is elastically deformed when in the pre-connected configuration 15. In particular, the corner 38 adjacent the top surface 35 is spread and deforms in a direction perpendicular to both the vertical axis 50 and the horizontal axis 51, or out of the page in FIG. 8 in the pre-connected configuration 15. Thus, this movement causes the corners 38 (FIG. 4) in the two grooved portions of the snap-fit connector 31 to move away from one another when moving thru the pre-connected configuration. After clearing catch surfaces 36, these corners snap back toward an undeformed configuration such that the snap-fit connection becomes permanent because the catch surfaces 36 block movement in a reverse direction by abutting top surfaces 35 of the grooves 33 and 34. When in the connected configuration, the two slab bolster uppers 11 and 12 are inhibited against any relative movement about any axis that is perpendicular to the horizontal axis 51 by maintaining the entire first vertical planar abutment surface 26 in contact with the entire second vertical planar abutment surface 30 in the connected configuration 16.

Although not necessary, the ornamental design of a slab bolster upper according to the present disclosure is illustrated in the various views shown in FIGS. 10-14. Those skilled in the art will appreciate that slab bolster uppers typically will be made in a variety of heights to suite the demands of a given reinforcement plan for a concrete pour. Thus, slab bolster uppers of the present disclosure might come in a variety of heights but all share a similar angle 55, or have different A-frame angles without departing from the present disclosure.

The present description is for illustrative purposes only, and should not be construed to narrow the breadth of the present disclosure in any way. Thus, those skilled in the art will appreciate that various modification might be made to the presently disclosed embodiments without departing from the full and fair scope and spirit of the present disclosure. Other aspects, features and advantages will be apparent upon an examination of the attached drawings and appended claims.

What is claimed is:

1. A plurality of slab bolster uppers comprising:

a first slab bolster upper that is identical to a second slab bolster upper, and each include a body having a rebar contact surface separated a height distance from a ground contact surface along a vertical axis, and the rebar contact surface extends from a first end to a second end of the body along a horizontal axis;

the first end terminating at a first vertical planar abutment surface that is one side of a thickness profile;

the second end has a different shape than the first end, includes a second vertical planar abutment surface and includes a snap-fit connector shaped to receive the thickness profile of the first end;

the first and second slab bolster uppers are movable from a disconnected configuration to a connected configuration exclusively responsive to sliding the second end of one of the bolsters relative to the first end of the other bolster along the vertical axis while the respective second vertical planar abutment surface is in contact with the respective first vertical planar abutment surface.

2. The plurality of slab bolster uppers of claim 1 wherein each of the slab bolster uppers consists solely of a single integral piece of molded plastic.

3. The plurality of slab bolster uppers of claim 1 wherein the slab bolster uppers have a pre-connected configuration between the disconnected configuration and the connected configuration that is characterized by the snap-fit connector being elastically deformed responsive to contact with the first end of the other bolster.

4. The plurality of slab bolster uppers of claim 3 wherein the snap-fit connector is undeformed in both the disconnected configuration and the connected configuration.

5. The plurality of slab bolster uppers of claim 1 wherein the snap-fit connector is a permanent snap-fit connector.

6. The plurality of slab bolster uppers of claim 1 wherein the snap-fit connector defines a pair of grooves that receive respective portions of the thickness profile that are located on opposite sides of a plane defined by the vertical axis and the horizontal axis.

7. The plurality of slab bolster uppers of claim 6 wherein an angle, which is greater than zero, between the grooves is bisected by the vertical axis.

8. A plurality of slab bolster uppers comprising:

a first slab bolster upper that is identical to a second slab bolster upper, and each include a body having a rebar contact surface separated a height distance from a ground contact surface along a vertical axis, and the rebar contact surface extends from a first end to a second end of the body along a horizontal axis;

the first end terminating at a first vertical planar abutment surface that is one side of a thickness profile;

the second end has a different shape than the first end, includes a second vertical planar abutment surface and includes a snap-fit connector shaped to receive the thickness profile of the first end;

the first and second slab bolster uppers are movable from a disconnected configuration to a connected configuration exclusively responsive to sliding the second end of one of the bolsters relative to the first end of the other bolster along the vertical axis while the respective second vertical planar abutment surface is in contact with the respective first vertical planar abutment surface;

wherein the first end includes a pair of catch surfaces that are oriented perpendicular to the vertical axis and located on opposite sides of a plane defined by the vertical axis and the horizontal axis; and the pair of catch surfaces block the snap-fit connector from moving from the connected configuration toward the disconnected configuration.

9. The plurality of slab bolster uppers of claim 1 wherein each of the slab bolster uppers consists solely of a single integral piece of molded plastic;

the slab bolster uppers have a pre-connected configuration between the disconnected configuration and the connected configuration that is characterized by the snap-fit connector being elastically deformed responsive to contact with the first end of the other bolster;

the snap-fit connector is undeformed in both the disconnected configuration and the connected configuration; and the snap-fit connector is a permanent snap-fit connector.

10. The plurality of slab bolster uppers of claim 9 wherein the permanent snap-fit connector defines a pair of grooves that receive respective portions of the thickness profile that are located on opposite sides of a plane defined by the vertical axis and the horizontal axis, and an angle between the grooves is bisected by the vertical axis;

the first end includes a pair of catch surfaces that are oriented perpendicular to the vertical axis and located on opposite sides of the plane defined by the vertical axis and the horizontal axis; and the pair of catch surfaces block the permanent snap-fit connector from moving from the connected configuration toward the disconnected configuration.

11. A method of joining a first slab bolster upper to a second slab bolster upper, comprising the steps of:

positioning the first slab bolster upper and the second slab bolster upper in a disconnected configuration;

moving the second slab bolster upper relative to the first slab bolster upper from the disconnected configuration to a connected configuration characterized by respective horizontal axes of the first and second slab bolster uppers being coincident;

wherein the moving step includes sliding a second vertical planar abutment surface of the second slab bolster upper along a vertical axis relative to, and in contact with, a first vertical planar abutment surface of the first slab bolster upper;

the moving step further includes receiving a thickness profile of one end of the first slab bolster upper into a snap-fit connector of the second slab bolster upper; and wherein the first vertical planar abutment surface is a terminal end of the first slab bolster upper.

12. The method of claim 11 wherein the first and second slab bolster uppers move through a pre-connected configuration when moving from the disconnected configuration to the connected configuration; and the snap-fit connector is elastically deformed in the pre-connected configuration.

13. The method of claim 11 wherein the snap-fit connector is undeformed in both the disconnected configuration and the connected configuration.

14. The method of claim 11 wherein the snap-fit connector is a permanent snap-fit connector that blocks the first and second slab bolster uppers from moving from the connected configuration toward the disconnected configuration.

15. The method of claim 11 wherein the snap-fit connector defines a pair of grooves that are located on opposite sides of a plane defined by the vertical axis and the horizontal axis;

the first vertical planar abutment surface is one side of a thickness profile at one end of the first slab bolster upper; and receiving different portions of the thickness profile into respective ones of the pair of grooves during the moving step.

16. The method of claim 11 wherein the first slab bolster upper includes a pair of catch surfaces that are oriented perpendicular to the vertical axis and located on opposite sides of a plane defined by the vertical axis and the horizontal axis; and the pair of catch surfaces block the snap-fit connector from moving from the connected configuration toward the disconnected configuration.

17. The method of claim 11 wherein the first slab bolster upper remains undeformed throughout the moving step.

18. The method of claim 11 including inhibiting relative movement of the first slab bolster upper relative to the second slab bolster upper about any axis perpendicular to the horizontal axis by maintaining the entire first vertical planar abutment surface in contact with the entire second vertical planar abutment surface in the connected configuration.

19. The method of claim 11 wherein the first and second slab bolster uppers move through a pre-connected configuration when moving from the disconnected configuration to the connected configuration;

the snap-fit connector is elastically deformed in the pre-connected configuration, and the snap-fit connector is undeformed in both the disconnected configuration and the connected configuration;

the first slab bolster upper remains undeformed throughout the moving step from the disconnected configuration, through the pre-connected configuration to the connected configuration.

20. The plurality of slab bolster uppers of claim 1 wherein a thickness profile spread angle defined by outer edges of the thickness profile acts as a wedge pushing grooves of the snap connector apart during movement from the disconnected configuration to the connected configuration.

* * * * *